US005089857A

United States Patent [19]

Xydias

[11] Patent Number: 5,089,857

[45] Date of Patent: Feb. 18, 1992

[54] ELECTROSTATOGRAPHIC APPARATUS HAVING SHEET COOLING AND TURNOVER DEVICES

[75] Inventor: Jean Xydias, Pittsford, N.Y.

[73] Assignee: Eastman Kodak Company, Rochester, N.Y.

[21] Appl. No.: 605,811

[22] Filed: Oct. 15, 1990

[51] Int. Cl.[5] ..... G03G 21/00

[52] U.S. Cl. ..... 355/318; 271/186; 355/308; 355/321

[58] Field of Search ..... 355/318, 321, 322, 202, 355/308, 309; 271/185, 186; 165/80.2-80.4; 162/206

[56] References Cited

U.S. PATENT DOCUMENTS 3,816,066 6/1974 Thettu et al. ..... 165/80.3
4,545,671 10/1985 Anderson ..... 355/309
4,992,833 2/1991 Derimiggio ..... 355/282
5,008,716 4/1991 Onose et al. ..... 355/322

FOREIGN PATENT DOCUMENTS 0248855 11/1986 Japan ..... 271/186
0150276 7/1987 Japan ..... 365/309
0270068 10/1989 Japan ..... 355/202

*Primary Examiner*—A. T. Grimley
*Assistant Examiner*—Matthew S. Smith
*Attorney, Agent, or Firm*—Tallam I. Nguti

[57] ABSTRACT

An electrostatographic apparatus for producing fused toner images on receiver sheets includes a heated fusing apparatus and a combination mechanism for cooling as well as turning over receiver sheets coming from the fusing apparatus. The combination mechanism includes an internally cooled drum that forms a sheet-transport nip with a roller driven belt, and a sheet turnover chamber with an externally mounted shroud.

19 Claims, 2 Drawing Sheets

ELECTROSTATOGRAPHIC APPARATUS HAVING SHEET COOLING AND TURNOVER DEVICES

BACKGROUND OF THE INVENTION

1. Technical Field

This invention relates to electrostatographic apparatus for producing fused toner images on receiver sheets, and more particularly, to such an apparatus which includes a heated fusing device, as well as sheet cooling and turnover devices.

2. Background Art

Electrostatographic apparatus such as copiers and printers are well known for producing fused toner images on receiver sheets. In such apparatus, the toner images are first formed on an image-bearing member and then transferred to one or a first, side of the receiver sheet. Subsequently, the receiver sheet is fed through a fusing device, that typically includes a heat source, where the toner images on the sheet, and the sheet itself, are heated in order to melt and thus fuse the toner images onto the sheet. The sheet may then be moved to a finishing area for immediate handling, or for accumulation, stapling, and handling thereafter. In order to prevent such sheets from sticking to each other, and in order to insure high quality for the fused images, the melted or fused toner must be quickly cooled before such accumulation and handling.

In some such apparatus, such post fusing handling includes reversing or turning over the receiver sheet so that a toner image, similarly formed, can be transferred to the other, or second, side of the sheet. Turning over the sheet, as such, takes time, and so also does cooling the same sheet as above.

Unfortunately, however, as electrostatographic apparatus are made to operate at higher and higher speeds, this usually requires higher and higher temperatures at the heat source of the fusing device in order to effectively fuse the toner image in a shortened cycle time, as well as shorter and shorter times for such post fusing cooling and turnover functions of the apparatus. Furthermore, customer demans for such apparatus to become smaller and more compact, as well as less expensive, are combining with the trend towards higher and higher speeds to create problems for conventional electrostatographic apparatus with separate, bulky and expensive devices for cooling and turning over receiver sheets.

SUMMARY OF THE INVENTION

It is, therefore, an object of the present invention to provide an electrostatographic apparatus which has compact, less expensive, and high speed sheet cooling and turnover devices.

It is a further object of the present invention to provide in such an apparatus a single combination mechanism for achieving such sheet cooling and sheet turnover functions.

In accordance with the present invention, an electrostatographic apparatus, including a heated fusing device, is provided for producing fused toner images on receiver sheets. The electrostatographic apparatus further includes a combination mechanism for both cooling and turning over a sheet coming from the fusing device. The combination mechanism includes (i) first means, whichinclude a rotatable drum, for transporting a sheet coming from the fusing device, (ii) second means, also including the drum, for cooling such a sheet, and (iii) third means, further including the drum, for turning over such a sheet so as to reverse the lead edge and image-receiving side thereof for use in the production of a two-sided image sheet thereof.

BRIEF DESCRIPTION OF THE DRAWINGS

In the detailed description of the invention presented below, reference is made to the drawings, in which.

DETAILED DESCRIPTION OF THE INVENTION

Figure 1:
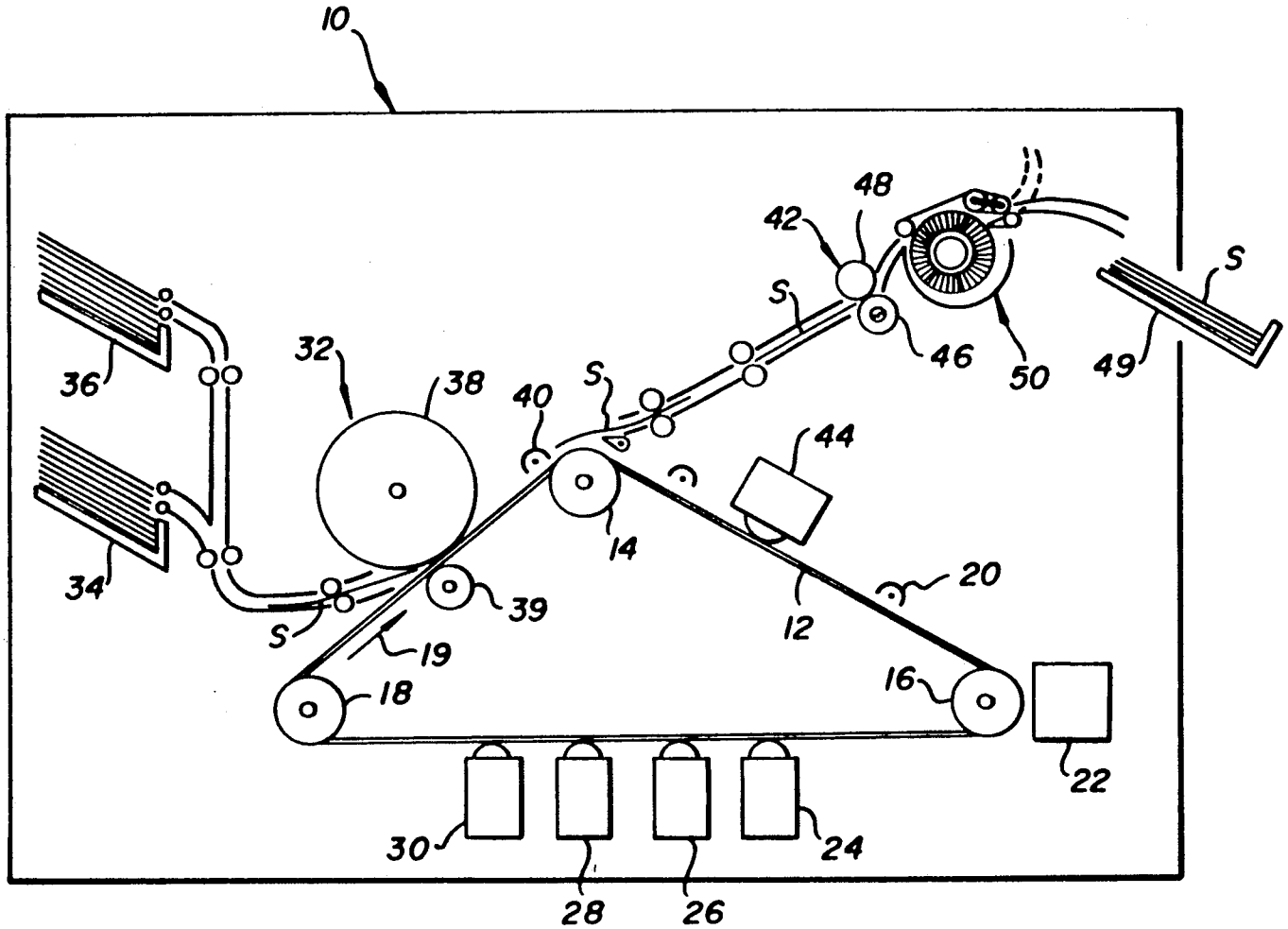
FIG. 1 is a schematic diagram of an electrostatographic apparatus incorporating the present invention.

Referring now to FIG. 1, an electrostatographic apparatus such as an electrostatographic printer, is shown generally as 10. The apparatus 10 includes an image-bearing member 12, for example, an endless photoconductive web trained about rollers 14, 16 and 18. One of the rollers can be a drive roller for moving the member 12 in the direction of the arrow 19.

The apparatus 10 also includes a charging station 20 which places a uniform charge on the surface of the member 12, an exposure station 22, shown as an electronic print head, for image-wise creating an electrostatic pattern from the laid-down charges. The electrostatic image patterns are next toned or developed with toner particles at one of the development stations 24–30. The toner-developed image is subsequently transferred, at a transfer station 32, onto one, or a first, side of a suitable receiver sheet S fed from a supply tray 34 or 36. As shown, the transfer station 32 includes a transfer drum 38 and a back-up roller 39. Following such transfer, the image-carrying sheet S is separated from the image-bearing member 12, for example, with the help of a corona device 40. Following separation from the receiver sheet S, the member 12 is then cleaned at a cleaning station 44 in preparation for reuse for similarly forming and transferring another toner image.

The sheet S, after separation, is then transported, for example, by rollers and guides as shown, to a fusing device 42. At the fusing device 42, the toner image on the one, or first, side of the receiver sheet S is heated and fused onto the sheet S, for example, by a heated fuser roller 46 including a heat source L, and a pressure roller 48. The sheet S is also heated during such fusing. Eventually, the sheet S with the fused image thereon may be transported through to, and accumulated, for example, in an output tray 49.

After such fusing, however, in order to prevent the sheets S from sticking to each other, for example, in the tray 49, the present invention includes a combination mechanism shown generally as 50, which includes means or devices therein for immediately cooling the sheet S after it exits the fusing device 42. In the present invention, the combination device 50 also includes means or devices therein for turning over the sheet S so as to reverse the lead edge and image-receiving side thereof for reuse therein in the production of a duplex or two-sided image sheet.

Figure 2:
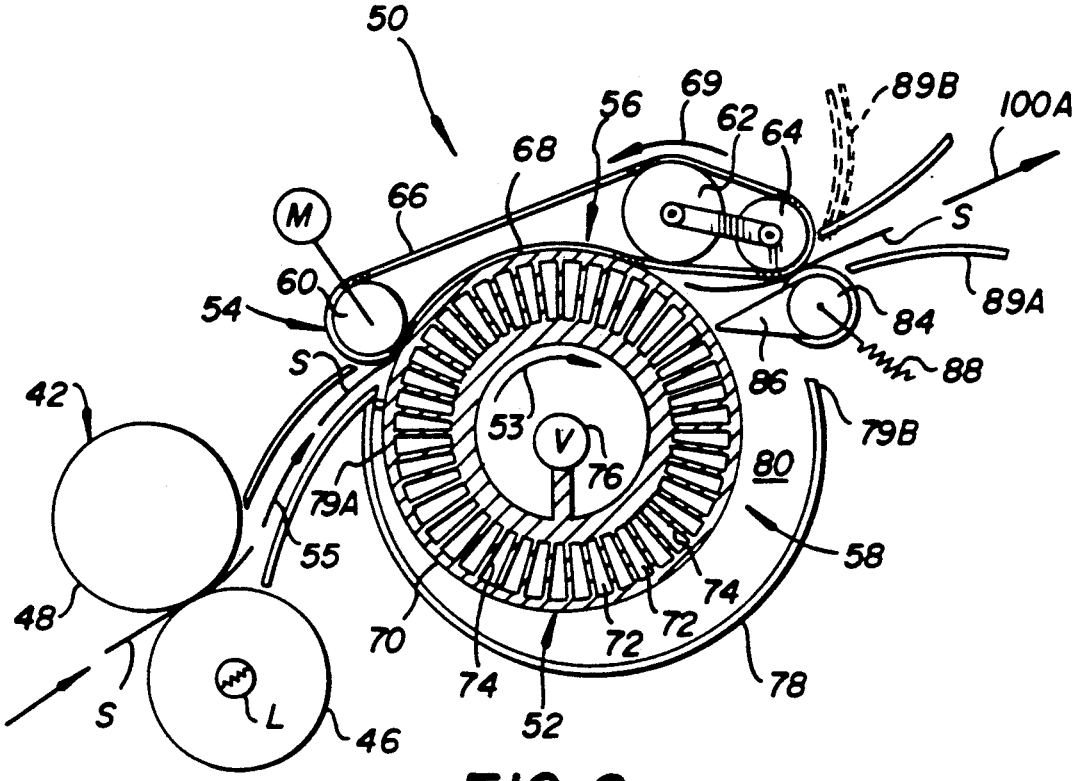
FIG. 2 is an end view, partly in section, showing the combination mechanism of the present invention in a cooling, straight-pass mode.
Figure 3:
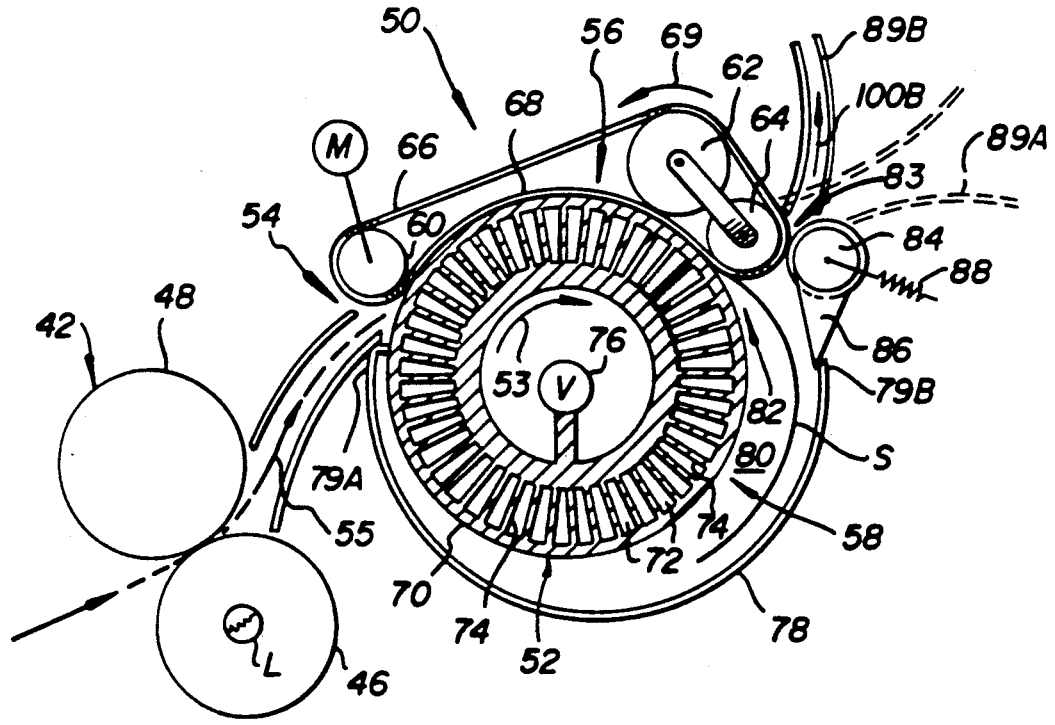
FIG. 3 is the same view as in FIG. 2 showing the combination mechanism of the present invention in a cooling, turnover mode.

Referring now to FIGS. 2 and 3, the combination mechanism 50 is shown in greater detail. As shown, the mechanism 50 includes a rotatable drum 52 that can be rotated in the direction of the arrow 53. As stated above, the mechanism 50 can be used effectively to both cool, as well as turn over a sheet S coming from the fusing device 42.

Accordingly, the mechanism 50 comprises first means or devices indicated generally as 54 for transporting a receiver sheet S coming from the fusing device 42 as shown by the arrow 55. The transport means 54 includes the rotatable drum 52. The mechanism 50 also comprises second means or devices indicated generally as 56 for cooling the sheet S being transported by means 54 as above. The cooling means 56 also includes the rotatable drum 52. Finally, the mechanism 50 further comprises third means indicated generally as 58 for turning over a sheet S (FIG. 3) so as to reverse the lead edge and image-receiving side thereof for reuse in the apparatus 10 for producing a two-sided or duplex image sheet. The turnover means 58, as shown, also further includes the rotatable drum 52.

The transport means 54 includes the drum 52, and a plurality of rollers, 60, 62, and 64 which are mounted externally adjacent a first portion of the drum 52. An endless flexible member, such as a belt, 66 is trained about the rollers 60–64. As shown, the flexible member 66 forms a sheet-transport nip 68 against such first portion of the outer surface of the drum 52. The rollers 60–64 are mounted over a significant portion of the perimeter of the drum 52 so as to make the transport nip 68, long and extended. One of the rollers 60–64, for example, roller 60 can be driven by drive means M and thus be the drive roller for driving the flexible member 66 in the direction of the arrow 69. The member 66 driven as such, can, in turn, frictionally drive or rotate the drum 52 as indicated, and thus cause a sheet S within the nip 68 to be transported therethrough in a left-to-right direction, for example. A sheet S coming from the fusing device 42 through guide means, as shown, can thus be picked up at the roller 60 by the drum 52 and member 66, and thereafter transported through the nip 68 towards the roller 64.

For effectively cooling the sheet S coming from the heated fusing device 42, the cooling means 56 includes a heat-conductive shell 70 which forms the outer perimeter of the drum 52, and heat-sink means consisting, for example, of open slots 72 and heat conductive fins 74 connected to the shell 70. The shell 70 and fins 74 may be made, for example, of aluminum. The means 56 also includes means such as a pump or blower 76 for forcibly moving a cooling fluid, such as air, through the slots 72 and against the fins 74 and inside of the shell 70 for dissipating heat from the fins, and hence from the shell 70. The cooling means 56 further includes means for holding the sheet S, to be cooled, in heat-transfer contact against the heat-conductive shell 70. As shown, the sheet holding means includes the endless flexible member 66 which is in a nip-forming relationship with the perimeter of the drum 52, thereby forming the nip 68 with the shell 70. Accordingly, the member 66 is therefore mounted against the shell 70, not just for moving a sheet S through the nip 68, but for doing so while also pressing the sheet S into intimate contact against the shell 70. As such, heat from the sheet is quickly dissipated through the cooled shell 70, through the cooled fins 74, and into the moving cooling fluid or air being moved through the slots 72 and against the shell and fins.

For turning over the sheet S, the turnover means 58 includes the drum 52 and a shroud 78 that is mounted externally about a second portion of the drum 52. As mounted, the shroud 78 is spaced from the shell 70 of the drum 52, while partially surrounding the second portion of the drum thereof. As shown, the shroud 78 is non-concentric with the drum. The nearest edge 79A thereof is closed against the shell 70 by a short member, but the other, or opposite edge 79B is spaced from the shell 70. As such, the shroud 78 defines a sheet turnover chamber 80 about such second portion of the drum 52.

As shown, the turnover means 58 further includes the roller 64. Referring now to FIG. 3, a first roller, the roller 64, forms a sheet entrance nip 82 with the drum 52 for sheets entering the chamber 80. The endless flexible member 66 trained about such roller 64 actually makes direct nip contact with the shell 70 of the drum 52 within the nip 82. A second roller 84, which is mounted externally to the member 66, forms a sheet exit nip 83 with the first roller 64 for sheets exiting the chamber 80.

Referring to FIGS. 2 and 3, as shown, the first roller, the roller 64 has a first position (FIG. 3) in nip forming contact with the drum 52, and a second position (FIG. 2) spaced from, and out of such nip-forming contact with the drum 52. The roller 64, as further shown, is connected to, and pivotably movable relative to, the roller 62 which is mounted within the member 66 between rollers 60 and 64. Additionally, the mechanism 50 includes a sheet diverter 86 that is movable by means including a spring 88. The diverter 86 is movable, as such, from a closed position (FIG. 2) in which it contacts the drum 52 and closes the entrance into the turnover chamber 80, to an open position (FIG. 3) in which it is pulled back from the drum 52 and clear of the turnover chamber 80. As such, the mechanism 50 is capable of operating in a sheet cooling and straight-pass mode (FIG. 2) or in a sheet cooling and turnover mode (FIG. 3).

In the straight-pass mode of FIG. 2, the pivotable roller 64 is in its second or spaced position relative to the drum 52, and the sheet diverter 86 is in its closed position in contact with the shell 70 of the drum 52. In this position, the diverter 86 operates essentially as a skive to separate the sheet S, being transported and cooled through the nip 68, from the shell 70, and hence to lead the sheet S into the exit nip 83 between the rollers 64 and 84. Sheets S in the straight-pass mode will thereafter follow the guides 89A, as shown by the arrow 100A, for example, into the output tray 49 (FIG. 1).

In the cooling/turnover mode (FIG. 3), the roller 64 is in its first position forming the sheet entrance nip 82 into the chamber 80, and the diverter 82 is in its open position (FIG. 3). A sheet S being transported through the transport and cooling nip 68 will accordingly be moved into the chamber 80 until the leading edge thereof bottoms out against the closing member at the edge 79A of the chamber 80. The chamber 80 is sized such that at such point that the trailing edge of the sheet S will barely be in contact with the surface of the moving flexible member 66 as trained about the roller 64. The arcuate shape of the chamber 80 additionally serves to bend the sheet S, thereby increasing its beam strength. The movement of the flexible member 66 and the bend in the chamber 80, as is well known, combine to cause the trailing edge of the sheet S, as shown, to move from the entrance nip 82 into the exit nip 83 formed by the rollers 64 and 84. Consequently, the trailing edge thereof is picked up within the exit nip 83, and the sheet S is then fed out of the chamber 80, directed by guides 89B along the direction of the arrow 100B (FIG. 3). As is well known, the sheet S turned over in this manner can be returned for receiving a second image on the other side so as to create a duplex or two-sided image sheet thereof.

The invention has been described in detail with particular reference to a presently preferred embodiment, but it will be understood that variations and modifications can be effected within the spirit and scope of the invention.

What is claimed is:

1. In an electrostatographic apparatus including a heated fusing device, for producing fused toner images on a receiver sheet, a combination mechanism for both cooling and turning over such a sheet, the combination mechanism including:

(a) first means, including a rotatable drum, for transporting such a sheet coming from the heated fusing device;

(b) second means, associated with said rotatable drum, for cooling such a sheet; and (c) third means, associated with said rotatable drum, for turning over such a sheet to reverse the lead edge thereof.

2. The mechanism of claim 1 wherein said transport means further includes:

(a) a plurality of rotatable rollers mounted externally adjacent said drum;

(b) a flexible endless member trained about said plurality of rollers;

(c) a sheet-transport nip formed by said flexible member against a first portion of the outer surface of said drum; and (d) means for moving said flexible member and said drum so as to cause a sheet in said transport nip to be moved therethrough.

3. The mechanism of claim 2 wherein said plurality of rollers are arranged adjacent said drum so as to form a long, extended sheet-transport nip between said flexible member trained thereabout, and a significant portion of the perimeter of said drum.

4. The mechanism of claim 2 wherein said flexible endless member is a belt.

5. The mechanism of claim 2 wherein said flexible endless member frictionally drives said drum.

6. The mechanism of claim 1 wherein said sheet cooling means further includes:

(a) a cooling fluid;

(b) a heat-conductive shell forming the outer perimeter of said drum;

(c) heat-sink means located within the interior of said shell for dissipating heat;

(d) means for forcibly moving said cooling fluid through said interior of said drum; and (e) means for holding such a sheet, to be cooled, in heat-transfer contact against said heat-conductive shell.

7. The mechanism of claim 6 wherein said cooling fluid is air.

8. The mechanism of claim 6 wherein said heat-conductive shell of said drum is made of aluminum.

9. The mechanism of claim 6 wherein said heat-sink means consists of slots for cooling fluid movement, and of heat-conductive fins connected to said shell for dissipating heat from said shell.

10. The mechanism of claim 6 wherein said sheet-holding means includes a flexible endless member in nip-forming relationship with the outer perimeter of said shell.

11. The mechanism of claim 1 wherein said means for turning over such a sheet includes:

(a) a shroud mounted externally adjacent a portion of said drum;

(b) a sheet turnover chamber defined about said drum by said shroud;

(c) a first roller forming a sheet entrance nip with said drum for a sheet entering said chamber; and (d) a second roller forming a sheet exit nip with said first roller for a sheet exiting said chamber.

12. The mechanism of claim 11 wherein said shroud, as mounted, partially surrounds said portion of said drum.

13. The mechanism of claim 12 wherein said shroud is non-concentric with said drum.

14. The mechanism of claim 11 wherein said first roller has a first position in nip-forming contact with said drum, and a second position spaced from and out of such nip-forming contact with said drum.

15. The mechanism of claim 11 wherein said sheet turnover means includes a sheet turnover mode, a sheet straight-pass mode, and a sheet diverter mounted for pivotable movement between a closed position and an open position about said exit nip for selectively switching said mechanism between said straight-pass mode and said turnover mode.

16. The mechanism of claim 11 wherein said first roller includes an endless flexible member trained thereabout for making direct nip contact with said drum.

17. An electrostatographic copier or printer for producing high-quality simplex and duplex images on receiver sheets, the copier or printer including:

(a) means including an image-bearing member for electrostatically forming a latent image onto said image-bearing member;

(b) means for developing said latent image using toner particles.

(c) means for transferring the toner developed image onto a first side of a receiver sheet;

(d) a device, including a heat source, for fusing said toner image onto said receiver sheet; and (e) a combination mechanism, positioned after said fusing device, for cooling said sheet, and for turning over said sheet to reverse the lead edge orientation thereof for reuse therein in the production of a duplex image thereon, said combination mechanism further including:

(i) means, including a rotatable drum, for transporting such a sheet coming from the heated fusing device;

(ii) means, associated with said rotatable drum, for cooling such a sheet; and (iii) means, associated with said rotatable drum, for turning over such a sheet so as to reverse the lead edge thereof.

18. A post fusing sheet turnover mechanism in a copier or printer having a heated fusing device, the turnover mechanism including:

(a) a first rotatable cylindrical member against which a sheet can be held;

(b) a shroud mounted externally to said first cylindrical member;

(c) a sheet turnover chamber for receiving a sheet being held about said first cylindrical member, said chamber being defined about said first cylindrical member by said shroud;

(d) a second rotatable cylindrical member forming a sheet entrance nip, with said first cylindrical member, into said chamber;

(e) a third rotatable cylindrical member forming a sheet exit nip, with said second cylindrical member, from said chamber; and (f) means for cooling said first rotatable cylindrical member so as to also cool the sheet being held thereagainst for turning over by said turnover mechanism.

19. In a copier or printer having a heated fusing apparatus, a mechanism for cooling a copy sheet leaving the fusing apparatus, the cooling mechanism including:

(a) a rotatable drum;

(b) a cooling fluid;

(c) a heat-conductive shell forming the outer perimeter of said drum;

(d) heat-sink means located within the interior of said shell for dissipating heat;

(e) means for forcibly moving said cooling fluid through said interior of said shell;

(f) means for holding such a sheet, to be cooled, in heat-transfer contact against said heat-conductive shell; and (g) means, including a shroud and nip-forming rollers, for turning over a sheet being cooled to reverse the lead edge orientation thereof for reuse in such copier or printer for producing a duplex image thereon.

* * * * *